US006910756B2

(12) United States Patent
Blum et al.

(10) Patent No.: US 6,910,756 B2
(45) Date of Patent: Jun. 28, 2005

(54) EYELID WITH MECHANICALLY DRIVEN SERVICE POSITION OVERRIDE

(75) Inventors: John N. Blum, Somerset, NJ (US); Bruce A. Bowling, Beavercreek, OH (US); David A. Huliba, Centerville, OH (US); David F. Tunmore, Xenia, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/254,726

(22) Filed: Sep. 25, 2002

(65) Prior Publication Data

US 2004/0056920 A1 Mar. 25, 2004

(51) Int. Cl.[7] ..... B41J 2/165
(52) U.S. Cl. ..... 347/22
(58) Field of Search ..... 347/22, 29, 90, 347/35, 73–83, 108; 400/693; 361/610, 616

(56) References Cited

U.S. PATENT DOCUMENTS 6,247,781 B1 * 6/2001 Blum ..... 347/29

OTHER PUBLICATIONS

Specification sheet for the MicroMo AM 1524 stepper motor, retrived from the internet on Aug. 8, 2004 from [http://www.mhatt.aps.anl.gov/~dufresne/Manuals/BP–8000/Micromo–AM1524.pdf].*

* cited by examiner

*Primary Examiner*—Thinh Nguyen
(74) *Attorney, Agent, or Firm*—Barbara Joan Haushalter

(57) ABSTRACT

A technique for sealing a printhead of an ink jet printer system on startup, opening the seal to print, and opening further on an arbitrary path for service, is provided for by the present invention. The ink jet printhead has an ink drop generator, a catcher located adjacent to the ink drop generator, and a catcher pan located below the catcher. An eyelid seals ink within the printhead on startup of the printer system. An actuator mechanism transmits movement to the eyelid along a predetermined path, having multiple positions for the eyelid. The eyelid is moved between open and closed positions by means of a dc motor. The open position is defined by the actuator means contacting a print position stop. Shifting the position of the print position stop allows the eyelid to open to a service position.

20 Claims, 6 Drawing Sheets

EYELID WITH MECHANICALLY DRIVEN SERVICE POSITION OVERRIDE

TECHNICAL FIELD

The present invention relates to the field of continuous ink jet printing and, more particularly, to an eyelid mechanism for sealing the printhead when not printing.

BACKGROUND ART

In continuous ink jet printing systems, the eyelid is a moveable seal which diverts ink on startup into the catcher, thereby recycling the ink while containing it within the printhead. The seal is formed against the lip of the metal catch plate, which is typically about 0.025 inches thick. The eyelid opens about 0.04 inches while the printer is printing, allowing the ink drops to pass onto the print media. The area behind the eyelid, containing the droplet generator and charging leads, is frequently accessed for cleaning over the life of a printhead.

The printhead is typically located over the top of a roller carrying the print media, with the ink drops moving downward in a roughly vertical direction. To assure good print quality, the printhead is 0.075 to 0.100 inches above the substrate. The eyelid must seal perpendicular to the drop path while not contacting the moving substrate on the roller. The motion paths of prior art have been limited to a linear sliding, or a single pivot. The linear paths of some prior art are guided by slots which are prone to collecting ink residue, leading to sticking or jamming of the eyelid.

Prior eyelids have used simple spring loaded solenoid actuators. The spring maintains the seal force until the solenoid opens it to a print position. However, the solenoid may create an excessive shock when the eyelid opens and impacts its print position stop. This shock jars the ink jet printhead, causing the printhead to malfunction. To prevent this, cushioning springs or rubber dampers are used to buffer the impact of the eyelid and solenoid plunger at the end of its travel.

Both the linear slide and the simple pivot eyelids are suitable for a seal moving a small distance from the sealed position to the print position. These configurations, however, do not move far enough to allow the operator to look at the jets and charging electrodes in a horizontal direction while they are cleaning the printhead. It is therefore necessary for the eyelid to be removed by a trained operator for printhead cleaning. This may entail removing screws and covers, necessitating the use of a tool for fasteners and the possibility that the parts may be lost or damaged on reassembly. Proper alignment of the sealing edge with the catchplate may be difficult to obtain after repeated disassembly, leading to leaks or poor startups.

An additional safety issue exists, since the printhead contains high voltage (~150 Volts). While operating, it is necessary to maintain proper ingress protection to avoid accidental contact with the charging electrodes. In the existing art the removal of covers by trained service personnel is the only means provided to prevent accidental access to the electrodes while the high voltage is on.

As mentioned earlier, it is possible for the eyelid to become stuck or jammed. The prior art, with a simple solenoid actuator, has no feedback of eyelid position or presence. If the eyelid jams while closing, no indication is made to the system of the malfunction. This could result in ink spraying out of the printhead during start up or shut down.

One existing patent, U.S. Pat. No. 6,247,781, described an improved eyelid mechanism to overcome some of the problems of other prior art systems. The '781 patent showed an eyelid that could be positioned, using a stepper motor, into the three positions of closed, print and service. The eyelid closed position seals the eyelid against the catcher to prevent ink from leaking from the printhead during start up and shutdown operations. The print position moves the eyelid seal away from the catcher to allow print drops to pass between the eyelid and the catcher on their way to the print media. A service position moves the eyelid much farther away from the catcher, providing a printhead operator better access for cleaning the printhead orifice plate and charge plate. It employs electro mechanical switches and a stepper motor drive to facilitate movement of the eyelid to those three positions. During motion of the eyelid, the eyelid is prevented from making contact with the paper. The stepper motor drives the eyelid into the three positions. Switch means detect that the eyelid is properly actuated to the desired locations.

While the eyelid mechanism of the '781 was effective in providing the three operating positions, it has been found that the switch means for detecting the eyelid position had certain drawbacks. First, the switch means has proven to be cumbersome to locate properly on the eyelid. Misplacement of the switches could result in either insufficient or excessive sealing forces being supplied to seal against the catcher. Second, the reliability of the switches exposed to the operating environment of the inkjet printhead can be inadequate. Third, the placement of the switches may interfere with the desired flow of air through the printhead. Fourth, a primary function of the switches was to detect possible eyelid actuation errors. The most common error has been a failure of the eyelid to open, due to the eyelid sticking to the catcher pan in the closed position.

It would be desirable to provide an improved eyelid actuation means to provide for the required three operating positions, that overcomes the problems associated with the prior art.

SUMMARY OF THE INVENTION

This need is met by the eyelid system of the present invention, wherein a multi-link mechanism is employed to define the eyelid seal translation path.

In accordance with one aspect of the present invention, a four-bar linkage is employed to define the eyelid translation path, using a gear box reduced dc motor rather than a stepper motor. The eyelid is moved to the closed position by supplying the motor with voltage in the normal direction. Reversing the voltage to the dc motor drives the eyelid to the open position. In both the open and closed position, the motor is driven to a dead stop. In the closed position, the dead stop is defined by contact between the eyelid seal and the catcher assembly. In the open position, the dead stop is defined by contact the linkage arm mechanism with a print position stop. Shifting the position of the print position stop allows the eyelid to open to a service position.

Other objects and advantages of the invention will be apparent from the following description, the accompanying drawing and the appended claims.

DETAILED DESCRIPTION OF THE PREFERRED EMBODIMENTS

Figure 1:
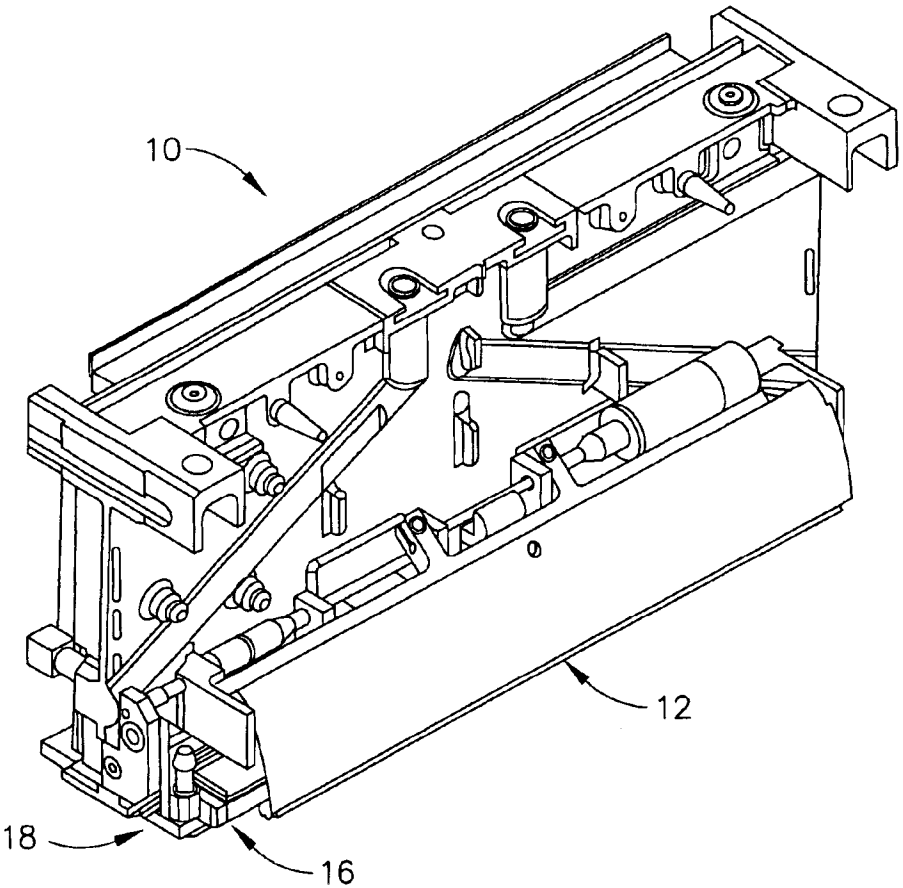
FIG. 1 is a perspective view of a printhead with the cover removed to illustrate the eyelid mechanism mounted to the printhead frame.

Referring to the drawings, and particularly to FIG. 1, there is illustrated a printhead 10, with the cover removed, to show the drop generator, 16, catcher 18 and eyelid assembly 12 are all mounted to a common printhead frame 14. During assembly, the catcher is secured to the printhead frame 14. The drop generator 16 is then precisely aligned with the catcher 18 as required to properly select print and non-print drops. It is secured to the printhead frame 14 to maintain the precise alignment. The eyelid assembly can then be mounted to the printhead frame. The eyelid assembly means 12 includes actuator means that can move the eyelid to a sealed position for startup and shutdown, and to an open position for printing to allow ink drops to pass between the catcher and the eyelid and be printed on a print media.

Figure 2:
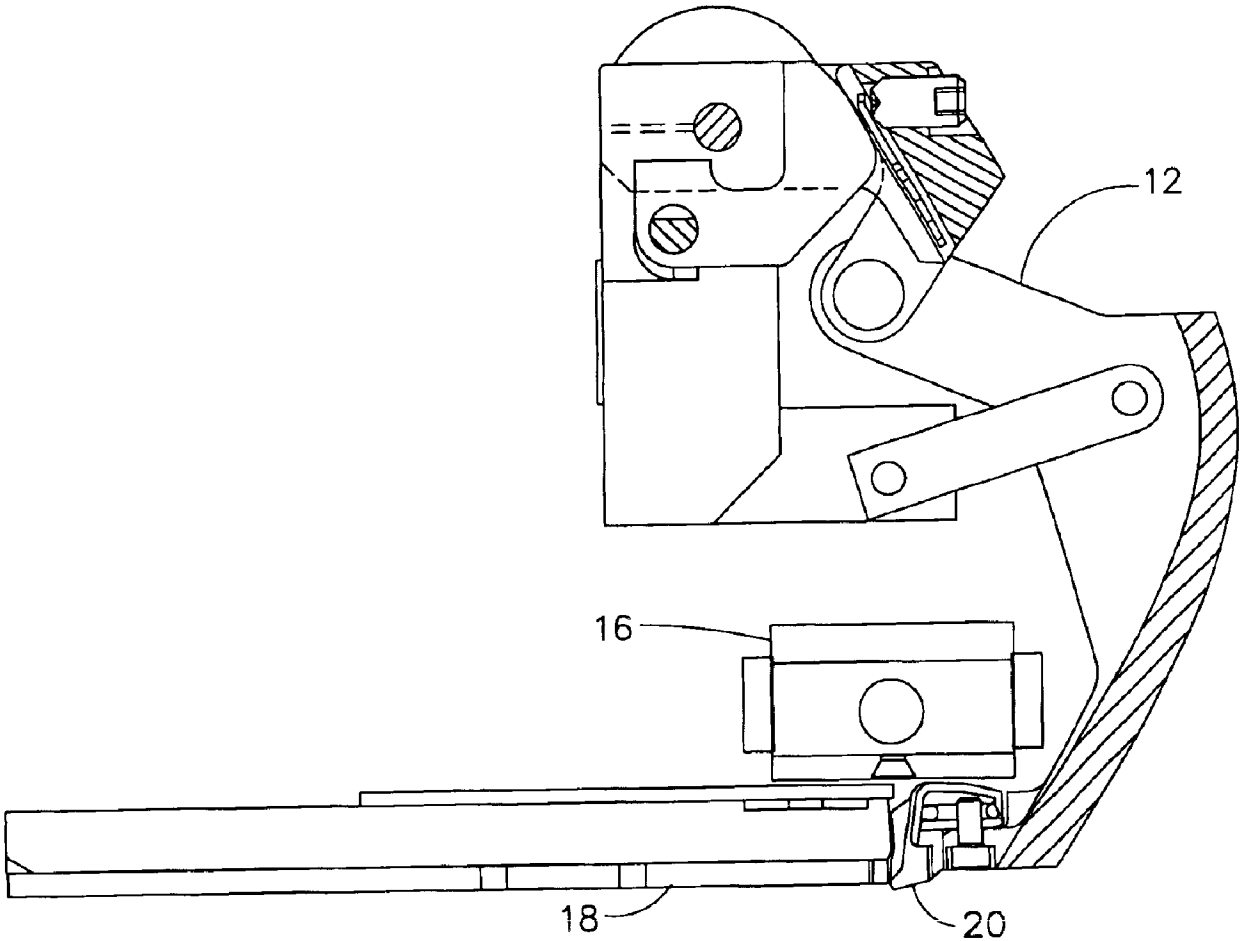
FIG. 2 illustrates the eyelid in a closed position.
Figure 3:
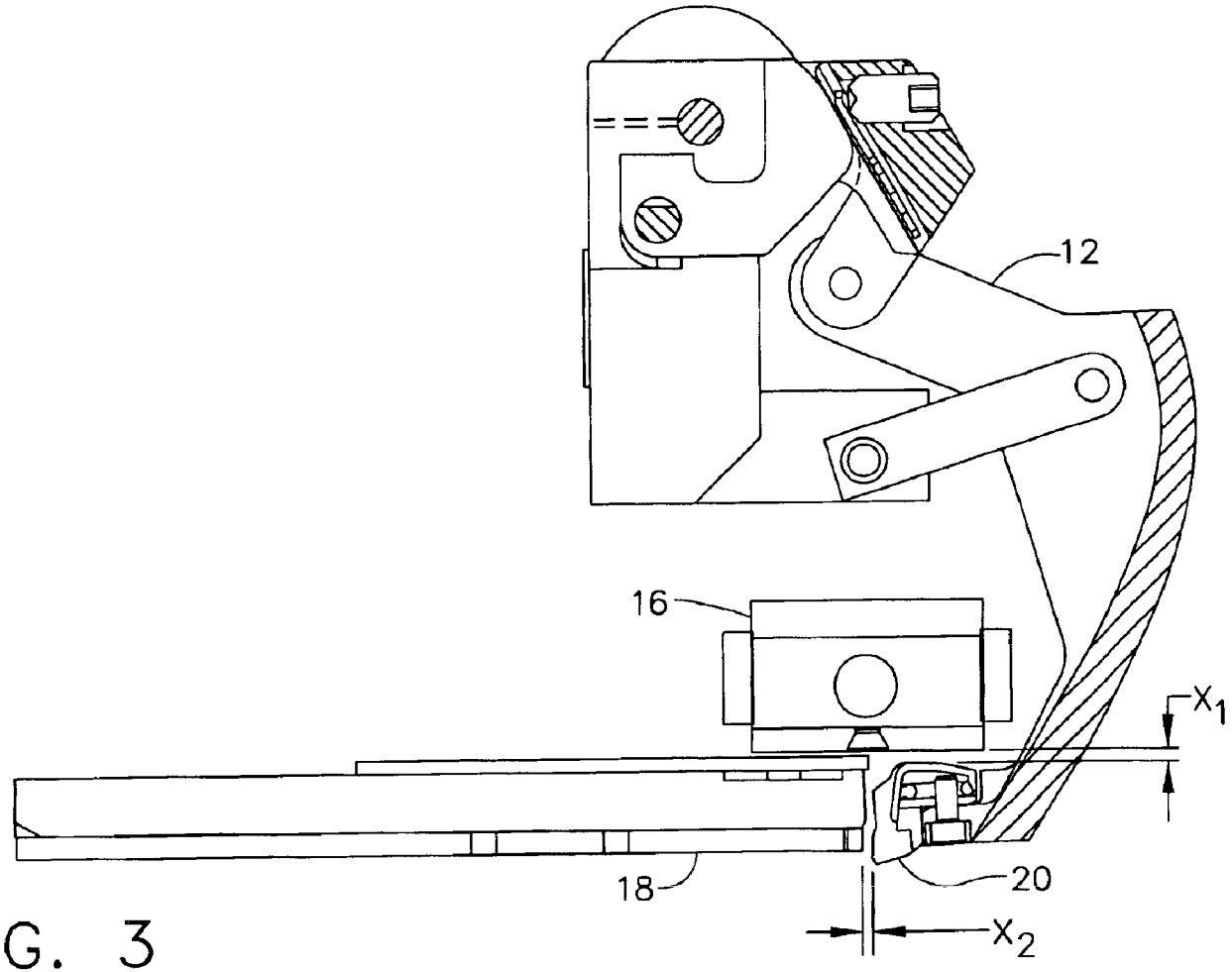
FIG. 3 illustrates the eyelid in a print position.
Figure 4:
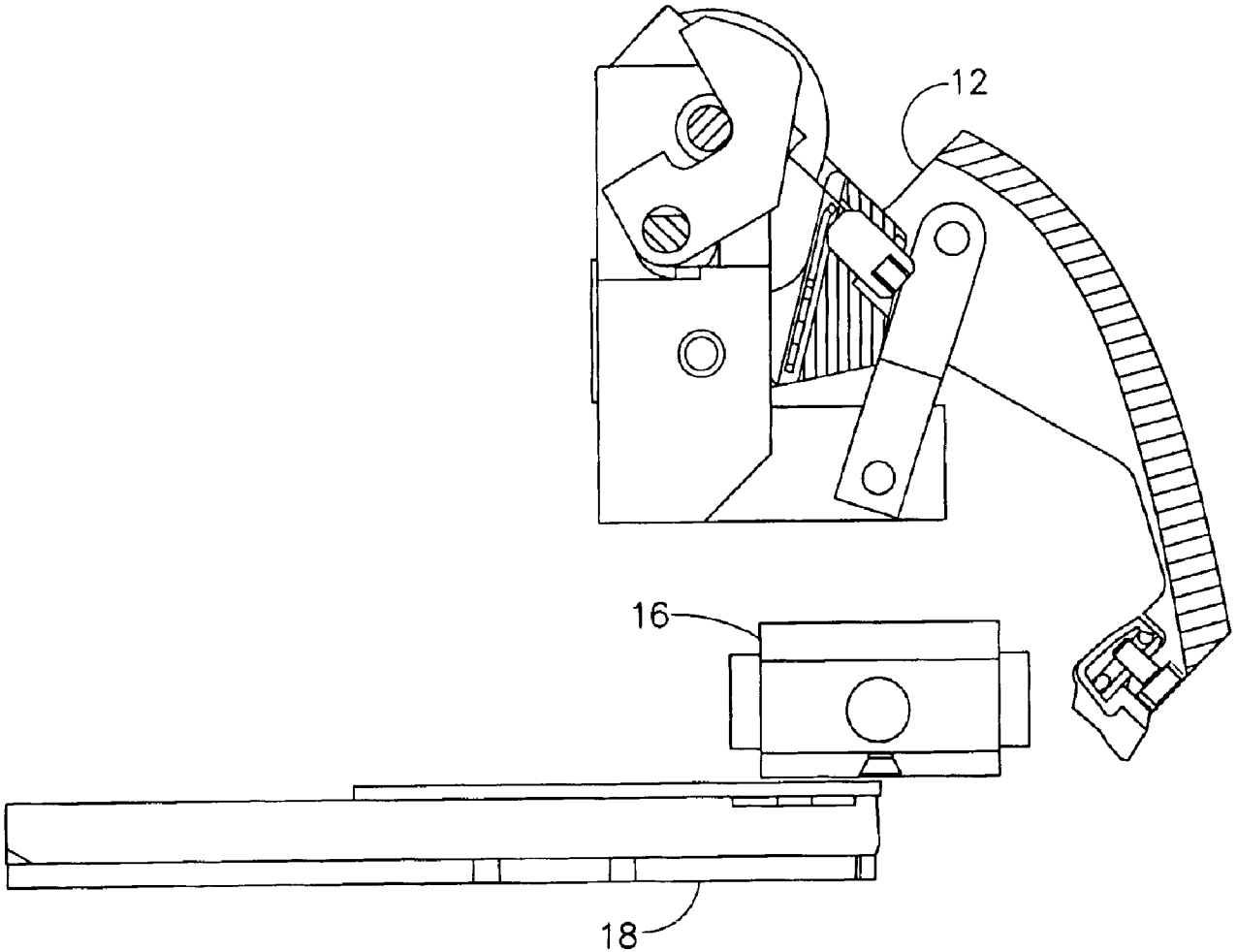
FIG. 4 illustrates the eyelid in a service position.

Referring now to FIGS. 2–4, the electromechanical device of the present invention provides a platform to move an eyelid seal 20 to different operating positions, including a closed position, as illustrated in FIG. 2; a print or open, as illustrated in FIG. 3; and a service position, as illustrated in FIG. 4. In the prior art, switch means were used to determine the location of the three operating positions. Replacing the switches with mechanical stops, as in the present invention, reduces complexity and eliminates reliability issues due to switch misplacement or performance variances.

Figure 6:
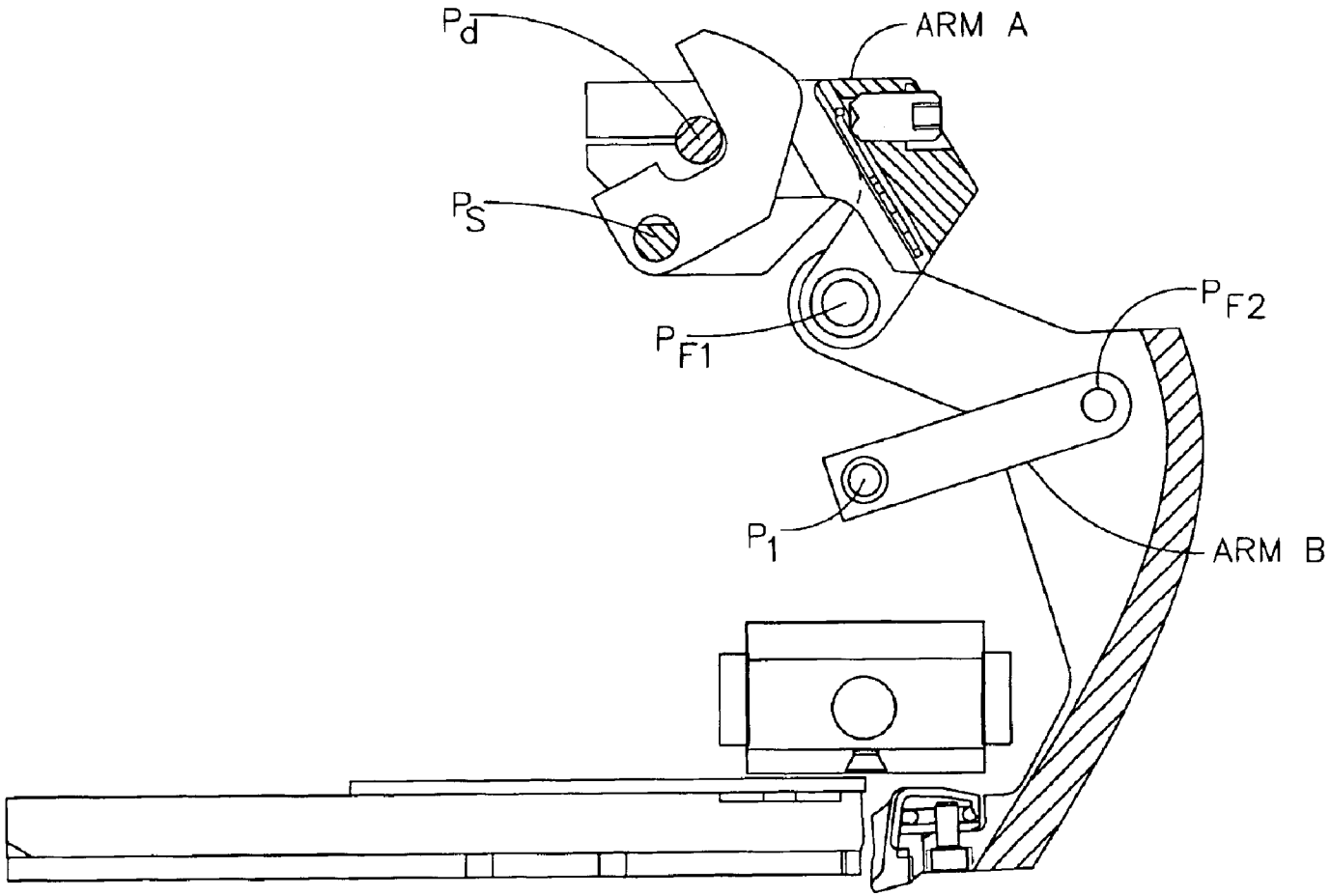
FIG. 6 illustrates the eyelid pivot points.

The eyelid assembly 12 is comprised of the eyelid 18 having an eyelid seal 20, an eyelid base 22, and a multi-link mechanism 24, all illustrated in FIG. 2. The multi-link mechanism 24 is employed to define the eyelid seal 20 translation path. The various pivot points in the eyelid assembly of the present invention are shown in FIG. 6, where pivots $P_d$ and $P_I$ are fixed to the eyelid base 22, although base 22 is not shown in FIG. 6. Pivots $P_{F1}$ and $P_{F2}$ are floating pivots. Pivot $P_d$ is the drive pivot with the torque supplied by a motor (not shown) directly coupled to pivot arm A. Supplying voltage in the normal direction to the motor produces a counterclockwise force to the pivot arm A. Floating pivot $P_{f1}$ therefore moves counterclockwise and up. This, in turn, causes the eyelid 18 to pivot around $Pf_2$ such that the eyelid seal 20 rotates down. This allows the eyelid to seal against the bottom of the catcher, as illustrated in FIG. 2. The motion stops when the eyelid seal contacts the catcher face at catcher assembly 19.

Reversing the polarity of the voltage to the dc motor reverses the motor torque and the motion of each of the pivot arms, causing the eyelid seal to pivot away from the catcher. In normal operation of the printhead, a print position stop 32 is placed as shown in FIG. 3. The outward pivoting of the eyelid stops when the pivot arm A rotates down and contacts the print position stop 32. The print position adjustment screw 36 associated with the pivot arm A can be used to adjust the stop position for the open eyelid. In a preferred embodiment of the present invention, the eyelid pivots out to provide a gap, preferably approximately a 0.035 inch gap $X_2$, between the eyelid and catcher while printing.

In accordance with the present invention, a service position is provided by rotating the print position stop 32 out of the print mode position, and into a service mode position shown in FIG. 4. In this position, the print position stop 32 no longer serves to stop the rotation of pivot arm A. This allows significantly more rotation of the pivot arm A and, therefore, of the eyelid. In the service position, the pivot stop occurs when the pivot arm A hits the eyelid base 22 As the precise positioning of the service position is not critical, an adjustment means to control this stop position is not required.

Figure 5:
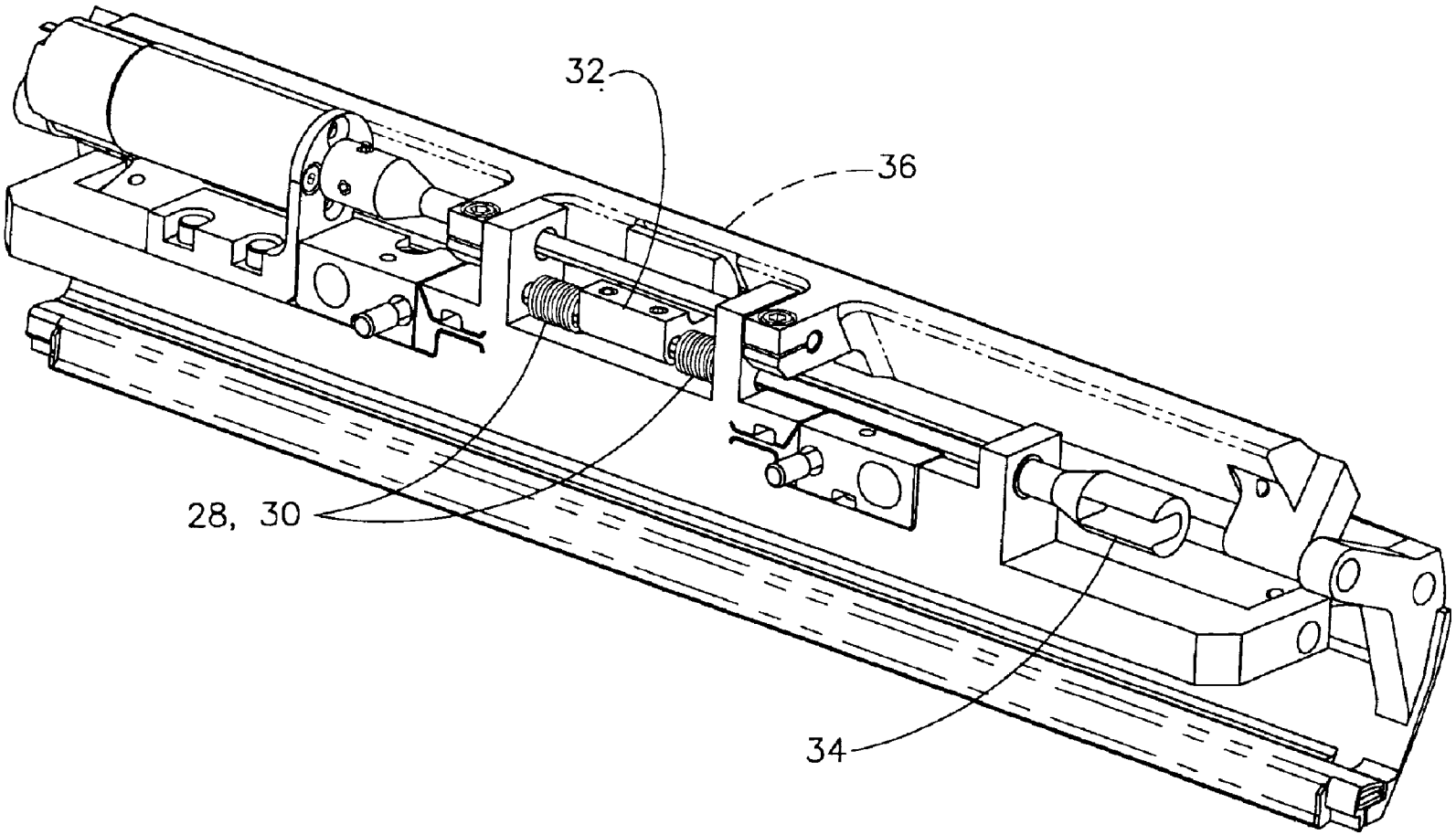
FIG. 5 is a perspective view showing placement of the print position stop on the eyelid actuating mechanism.

FIG. 5 illustrates the placement of the print position stop 32 relative to other components associated with the eyelid actuating mechanism. As shown in FIG. 5, the print position stop 32 is mounted on the stop rotation shaft 34. A tool can be used to engage the end of the stop rotation shaft to allow an operator to effectively rotate the print position stop from its print position to its service position. This shaft is biased to the print mode position by stop return springs 28 and 30. Therefore, once the tool for rotating the shaft 34 is removed, the stop will return to its normal position when the eyelid leaves the service position. After the eyelid is again closed, the eyelid will only open up to the print position unless the print position stop is again rotated to allow extension to the service position.

Since the interior of the printhead can contain high voltage electrodes which might be exposed to contact by the operator, safety interlocks, not shown, can be employed to disable high voltages in the printhead when the print position stop is being rotated out of its print position. Alternatively, one might require a special tool, available to trained operators, to engage and rotate the stop rotation shaft.

FIG. 5 also shows the placement of the dc motor means 26 which drives pivot arm A by way of torque coupler 48. In the present invention, no position sensors are employed to determine the open and closed eyelid positions. Rather, these positions are defined by driving the eyelid assembly to a dead stop. The closed position is defined by the eyelid seal making contact with the catcher assembly. The print open position is defined by contact between the print position adjustment screw 36 in the pivot arm A making contact with the print position stop 32. The service open position is defined by contact between the pivot arm A and the eyelid base 22.

In accordance with the present invention, the torque of the motor is chosen to be high enough to effect a good seal between the eyelid and catcher, but low enough to avoid damage to the various components. For example, in a preferred embodiment of the present invention, a model 1516TOO9SR-16/7-592:1-X0520R dc motor with 592:1 reducing gear box from MicroMo Electronics, Inc., is employed. It has been found that this motor can open or close the eyelid rapidly without producing excessive mechanical requirements in the printhead when the eyelid reaches its end of travel conditions. Voltage is supplied to this motor to actuate the eyelid assembly.

In accordance with the present invention, motor current changes significantly when the eyelid stops moving in either the closed or open positions. Detection of the motor current therefore provides a means to confirm that the eyelid has stopped moving. In one preferred embodiment, printer control means, not shown, can effect a reduction in the motor voltage to the holding voltage from the actuating voltage only after such current detection means have confirmed that the eyelid has stopped. In another embodiment, a current limited power supply may be used to reduce the holding voltage to the stalled motor. In another embodiment, the holding voltage is kept the same as the actuating voltage, that is, the voltage is not reduced after the eyelid has reached the end of travel.

In another embodiment, the printer control means monitors the time required for the current detection means to detect that the eyelid has stopped after the onset of applying to the motor an actuation voltage to open or close the eyelid. If the eyelid were to be stuck in one of the positions, the current detection means would detect a stalled eyelid actuator immediately, rather than after the normal eyelid actuation time. The printer control means can therefore identify such an eyelid actuation failure. Conversely, if the current detection means fails to detect the stoppage of the eyelid actuator within an appropriate amount of time, it may imply a failure in the eyelid actuator mechanism, such as a defective motor. Again, the printer control means can identify such a failure.

The present invention, therefore, can actuate eyelid means to closed, print open, and service open positions without the need for position detecting switches, as well as providing means to detect eyelid actuation errors without the need for position detecting switches. The present invention further provides means to restrict exposure of untrained operators to the high voltages present within the printhead.

The invention has been described in detail with particular reference to certain preferred embodiments thereof, but it will be understood that modifications and variations can be effected within the spirit and scope of the invention.

What is claimed is:

1. An ink jet printer system, comprising:

an ink jet printhead having an ink drop generator, a catcher located adjacent to the ink drop generator, and a catcher plate located below the catcher;

an eyelid for sealing ink within the printhead on startup of the printer system;

an actuating means for opening and closing the eyelid;

a movable mechanical eyelid stop means which define a first eyelid open position to facilitate printing when said movable eyelid stop means is in a first position, and a second and wider eyelid open position to facilitate printhead servicing when said movable eyelid stop means is shifted to a second position; and shifting means for shifting the movable eyelid stop means between the first and second positions, wherein the eyelid stop means stops the eyelid by physically contacting one of the eyelid and the actuating means.

2. An ink jet printer system as claimed in claim 1 wherein the shifting means comprises means to rotate the movable eyelid stop means.

3. An ink jet printer system as claimed in claim 1 wherein the actuating means comprises a dc motor.

4. An ink jet printer system as claimed in claim 3 wherein voltage to the dc motor is reduced when the eyelid reaches the first or second open position.

5. An ink jet printer system as claimed in claim 3 wherein changes in polarity of voltage of the dc motor affect direction of movement of the eyelid.

6. An ink jet printer system as claimed in claim 3 further comprising means to monitor current to the dc motor to detect stoppage of movement of the eyelid during actuation.

7. An ink jet printer system as claimed in claim 1 wherein the actuating means comprises a multi-pivot actuating means.

8. An ink jet printer system as claimed in claim 7 wherein the multi-pivot actuating means comprises a multiple bar linkage system.

9. An ink jet printer system as claimed in claim 8 wherein the multiple bar linkage system comprises a four bar linkage.

10. An ink jet printer system as claimed in claim 1 further comprising safety interlock means for disabling high voltage electrodes when the movable eyelid stop means are not in the first open position.

11. An eyelid assembly for a continuous ink jet printing system, the eyelid assembly comprising:

a dc motor for moving the eyelid to a plurality of positions; and eyelid stop means for stopping the eyelid at any of the plurality of positions, wherein the eyelid stop means stops the eyelid by physically contacting a portion of the eyelid assembly.

12. An eyelid assembly as claimed in claim 11 wherein the plurality of eyelid positions comprises at least a closed position, a print open position and a service open position for the eyelid.

13. An eyelid assembly as claimed in claim 12 wherein the eyelid stop means comprises means to rotate a stop for the print open position out of the print open position to allow rotation of the eyelid to the service open position.

14. An eyelid assembly as claimed in claim 11 wherein changes in current of the dc motor indicate movement of the eyelid to one or more of the plurality of positions.

15. An eyelid assembly as claimed in claim 11 further comprising safety interlock means for disabling high voltage electrodes when the eyelid stop means is not in the print open position.

16. An eyelid assembly as claimed in claim 11 further comprising a multi arm linkage along a predetermined eyelid translation path.

17. An eyelid assembly as claimed in claim 11 wherein the dc motor comprises a gear reduced dc motor.

18. An ink jet printer system, comprising:

an ink jet printhead having an ink drop generator, a catcher located adjacent to the ink drop generator, and a catcher plate located below the catcher;

an eyelid for sealing ink within the printhead on startup of the printer system;

an actuating means for opening and closing the eyelid, the actuating means comprises a motor;

a movable eyelid stop means which define a first eyelid open position to facilitate printing when said movable eyelid stop means is in a first position, and a second and wider eyelid open position to facilitate printhead servicing when said movable eyelid stop means is shifted to a second position;

shifting means for shifting the movable eyelid stop means between the first and second positions; and means to monitor current to the motor to detect stoppage of movement of the eyelid during actuation.

19. An ink jet printer system as claimed in claim 18 wherein voltage to the motor is reduced when the eyelid reaches the first or second open position.

20. An ink jet printer system as claimed in claim 18, further comprising a printer control means operable to determine when the motor has stalled.

* * * * *